United States Patent [19]

Kirchner et al.

[11] Patent Number: 4,828,429

[45] Date of Patent: May 9, 1989

[54] DETACHABLE LIQUID DISTRIBUTION UNIT

[75] Inventors: James R. Kirchner, Hastings, Minn.; Dennis A. Meyer, Stevens Point; Arlen L. Kluck, Plover, both of Wis.

[73] Assignee: Koch Materials Company, St. Paul, Minn.

[21] Appl. No.: 34,778

[22] Filed: Apr. 3, 1987

[51] Int. Cl.[4] ..... E01C 19/16

[52] U.S. Cl. ..... 404/111; 404/86

[58] Field of Search ..... 404/76, 85, 86, 111; 239/146, 159, 172, 176; 414/460

[56] References Cited

U.S. PATENT DOCUMENTS

| | | | |
|---|---|---|---|
| 1,048,165 | 12/1912 | Horne et al. | 404/111 X |
| 1,729,574 | 9/1929 | Finley | 404/111 X |
| 2,657,938 | 11/1953 | Browne et al. | 414/460 X |
| 3,361,358 | 1/1968 | Lund | 404/111 X |
| 4,311,274 | 1/1982 | Neal | 404/111 X |
| 4,315,700 | 2/1982 | Heiligtag et al. | 404/111 |
| 4,684,062 | 8/1987 | Bagwell | 239/159 X |
| 4,725,004 | 2/1988 | Baran, Jr. | 239/172 X |

FOREIGN PATENT DOCUMENTS

| | | | |
|---|---|---|---|
| 2102865 | 2/1983 | United Kingdom | 404/111 |

*Primary Examiner*—Jerome W. Massie
*Assistant Examiner*—Matthew Smith
*Attorney, Agent, or Firm*—Kokjer, Kircher, Bradley, Wharton, Bowman & Johnson

[57] ABSTRACT

A distributor for application of bituminous or other products to road surfaces. A spray bar, pump and hydraulic motor are mounted on a framework. The framework may be detachably coupled with a mounting frame on a trailer. A carriage is provided which will support the distributor during coupling with and removal from the trailer mounting frame.

4 Claims, 2 Drawing Sheets

DETACHABLE LIQUID DISTRIBUTION UNIT

BACKGROUND OF THE INVENTION

This invention relates in general to road construction equipment and, more particularly, to a distribution unit which may be readily installed or detached to a tank truck for use in the application of liquid bituminous material and other products to road or other surfaces.

Distribution units or distributors are used to apply bituminous products to road surfaces for dust control and as preparation for surfacing operations. Conventional distributors are designed for permanent attachment to the chassis of a truck having a tank for containing a supply of the bituminous product. The permanently attached distributors, however, make these trucks unsuitable for over the road hauling of the bituminous product and large tanker trailers must be utilized for this purpose. These two types of trucks represent a significant capital investment and maintenance expense because many of these trucks contain heating and circulation units which prevent solidification of the bitumen. Therefore, it would be desirable if each of these trucks were capable of performing the dual functions of hauling and distributing the liquid material.

SUMMARY OF THE INVETNION

It is an object of this invention to provide a distributor which may be detachably coupled with a tanker trailer containing a bituminous product so that the trailer may be utilized for hauling of the product and for application of the product to a road surface.

It is a further object of this invention to provide a carriage which may be used to support the distributor so that it may be quickly coupled with or detached from the tanker trailer.

These and other objects of the invention which will be apparent to those of skill in the art, are attained by the use of a distributor comprising a frame which may be detachably coupled with the tanker trailer, a spray bar coupled with the frame, conduits for connecting the spray bar with the tanker trailer, and a pump mounted on the frame for pumping a fluid through the conduits to the spray bar.

DESCRIPTION OF THE PREFERRED EMBODIMENT

Figure 1:
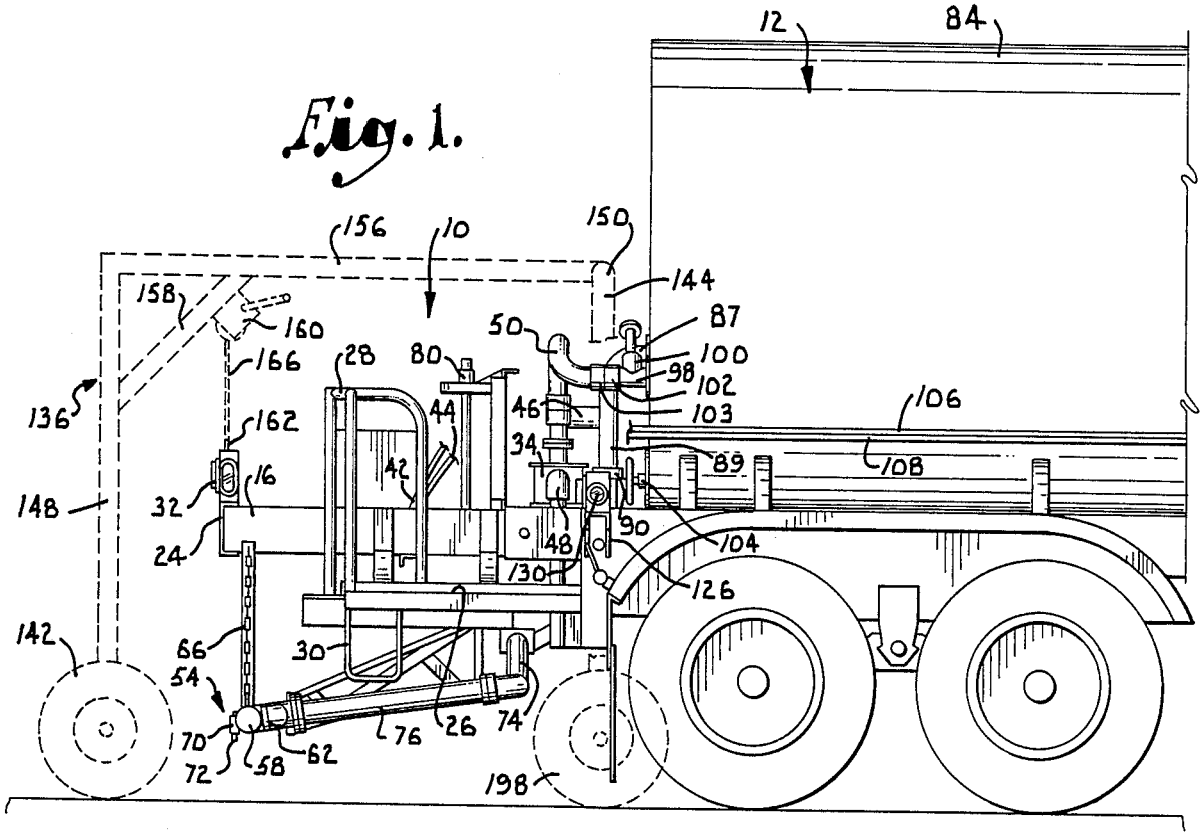
FIG. 1 is a side elevational view of a distributor of the present invention coupled with a tanker trailer and a carriage which represented in broken lines.

Referring now to the drawings in general, a distributor 10 of the present invention is coupled with the back end of a tanker trailer 12. Distributor 10 includes a framework 14 which comprises a pair of spaced apart side beams 16 and 18, a central cross-beam 20, a cross-beam 22 located at a forward end of side beams 16 and 18, and a cross-beam 24 located at a rear end of the side beams. Beam 24 extends laterally from the side beams and also serves as a bumper for the distributor. Platforms 26 and 27 are mounted on opposed sides of the framework and safety rails 28 and 29 and step rungs 30 and 31 are mounted on platforms 26 and 27, respectively. A pair of tail lights 32 and 33 are mounted on the beam 24.

A hydraulic-driven pump 34 is mounted on framework 14 and is driven by a shaft 36 coupled with a hydraulic motor 38. A universal coupling 40 connects the motor with shaft 36. Motor 38 is coupled with a truck hydraulic reservoir (not shown) by hydraulic pressure line 42 and hydraulic return line 44 and is hydrostatically controlled. Other types of motors may also be used to drive the pump.

Figure 3:
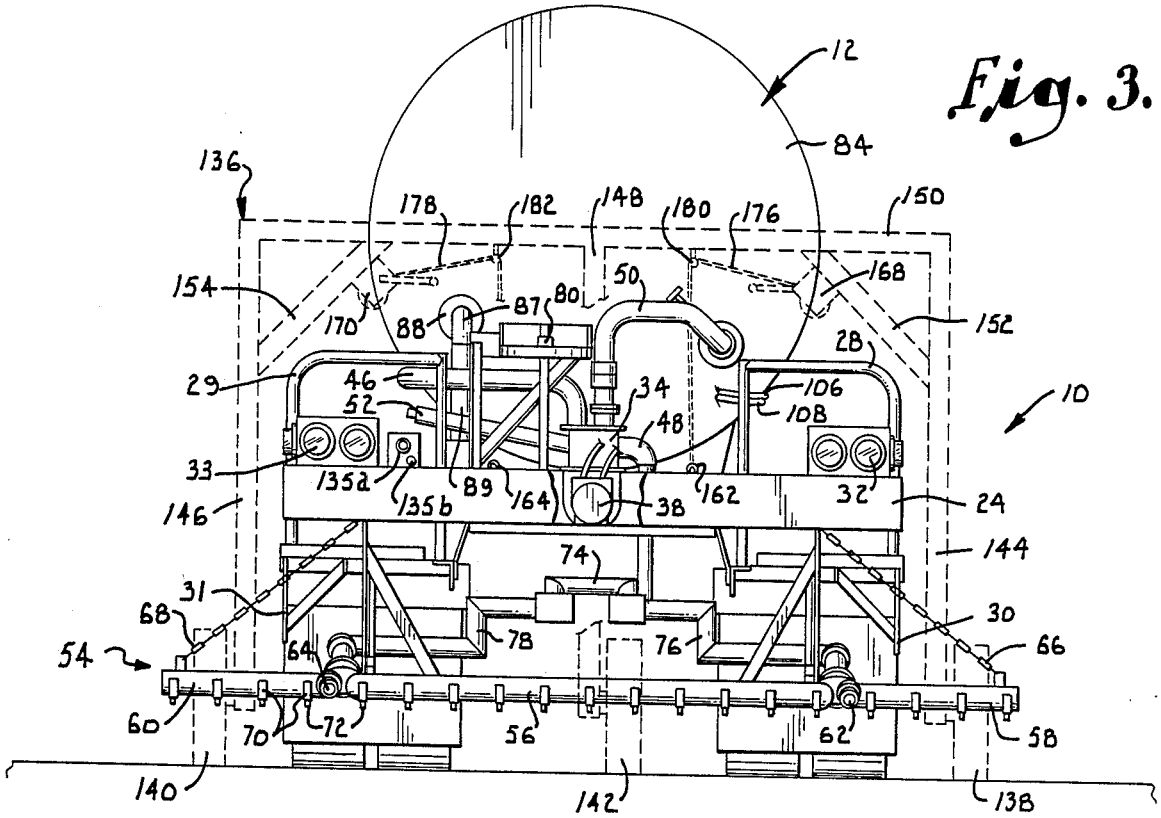
FIG. 3 is a rear elevational view of the distributor with the carriage shown in broken lines.

As best shown in FIG. 3, a suction line 46, distributing line 48, return line 50 and fill line 52 are coupled with the pump 34. Distribution line 48 is coupled with a spray bar 54 mounted on framework 14. The spray bar 54 comprises a central section 56 and hinge sections 58 and 60 which are located on opposed ends of section 56. Extension hinges 62 and 64 allow sections 58 and 60, respectively, to be folded to an upright position during transport of the distributor. Chains 66 and 68 support the hinge sections when they are deployed in their operating position as shown in FIG. 3. Spray bar 54 includes a series of individual nozzle valves 70 which control operation of V-slot spray nozzles 72 positioned along the spray bar. The distribution line 48 is divided by a cross-header 74 into lateral lines 76 and 78 which lead to the spray bar and allow circulation of a fluid within the spray bar 54. A control lever 80 is coupled by linkage 82 to flow valves (not shown) which control the circulation of the liquid in the spray bar 54.

Figure 2:
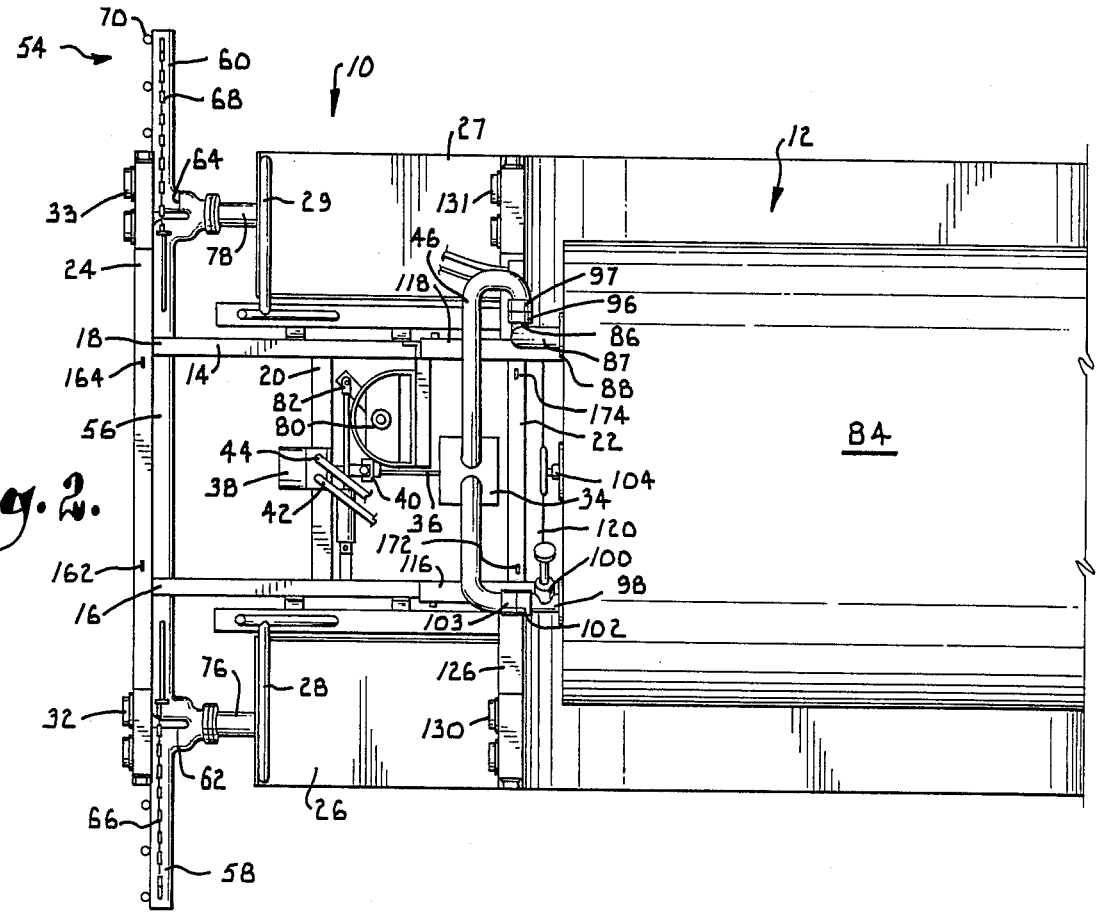
FIG. 2 is a top plan view of the distributor shown in FIG. 1.
Figure 4:
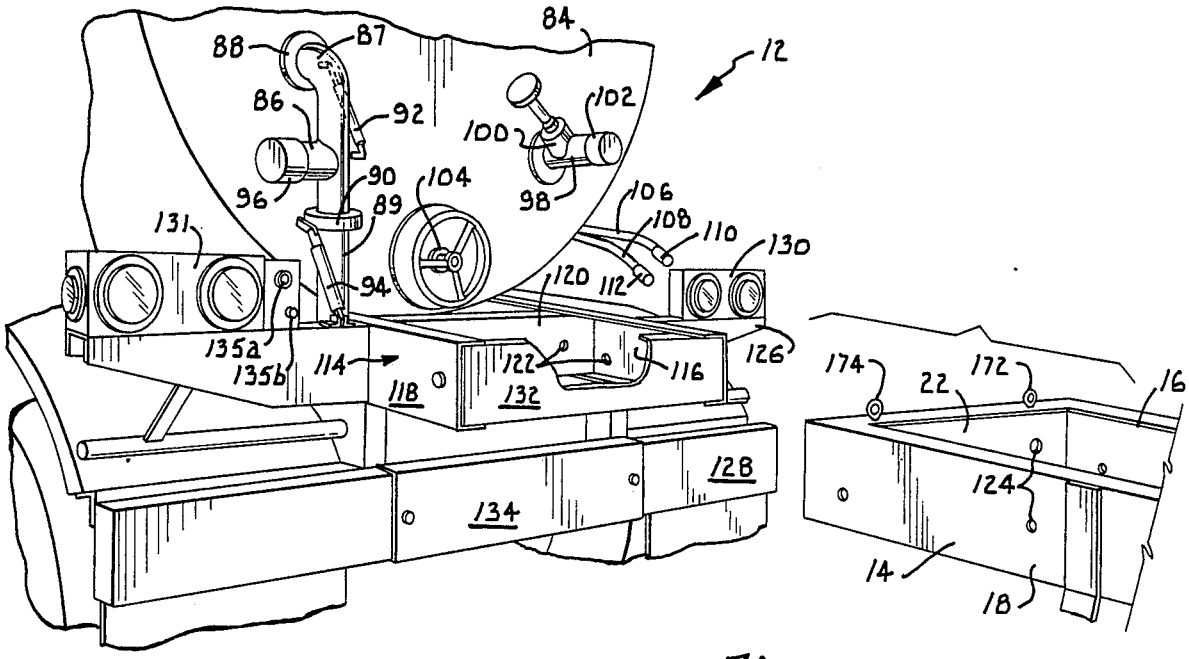
FIG. 4 is a rear perspective view of the tanker trailer with a frame of the distributor shown in fragment.

Turning now to FIG. 4, the tanker trailer 12 comprises a tank 84 for storage of the liquid product. The liquid in the tank is directed to the distributor 10 by a flow line 86. A first extension 87 of flow line 86 leads to a front portion of the tank and is regulated by a control valve 88. A second extension 89 of flow line 86 is coupled with a rear portion of the tank. A second control valve 90 in flow line extension 89 regulates flow of liquid from the rear portion of the tank. An air ram 92 controls operation of control valve 88 and a second air ram 94 controls operation of the second control valve 90. Fittings 96 and 97 (FIG. 2) are provided on flow line 86 and suction line 46 for coupling the lines together. Fittings 96 and 97 are preferably of a type which allows for quick connection of lines 86 and 46. The tank also includes a return line 98 which is regulated by valve 100. Fittings 102 and 103 are provided on line 98 and distributor return line 50 (FIG. 2) for coupling the lines. A sampling valve 104 is centrally located on the rear end of the tank and hydraulic lines 106 and 108 run along the side of the tank and connect the hydraulic reservoir with the hydraulic motor 38. Couplings 110 and 112 are provided for connecting lines 106 and 108 with lines 42 and 44.

A mounting frame 114 is coupled with the trailer 12 for mounting the distributor 10. The frame 114 comprises a pair of inwardly facing and spaced apart C-shaped members 116 and 118. Another member 120 is coupled with the forward ends of members 116 and 118. Members 116, 118 and 120 form the open ended frame 114 which is positioned for receiving the framework 14. The members contain apertures 122 which align with apertures 124 in framework 14 when the distributor is mounted on the trailer. Bolts may be inserted through the apertures 122 and 124 to securely fasten the distributor 10 to the tanker trailer 12.

The trailer 12 also includes an upper bumper 126 and a lower bumper 128. Tail lights 130 and 131 are mounted on the upper bumper 126 and a central section of lower bumper 128 is removed to accommodate the distributor 10. When distributor 10 is removed from the trailer 12, a temporary bumper 132 is attached to bumper 128 to cover the removed central section. The mounting frame 114 is located centrally of the upper bumper 126. A temporary bumper 134 may be fastened to the end portion of members 116 and 118 to cover the open end of frame 114 when the distributor is removed. A pneumatic line fitting 135*a* and wiring plug 135*b* are mounted to bumper 126 and are positioned adjacent tail light 131.

Turning now to FIGS. 1 and 3, a three-wheeled support carriage which may be used to position the distributor 10 during coupling with the trailer 12 is represented generally by the numeral 136. The carriage 136 comprise wheels 138, 140 and 142 which are coupled with vertical support posts 144, 146 and 148 respectively. A load bearing bar 150 connects posts 144 and 146 and is braced by members 152 and 154. Another load bearing bar 156 couples support post 148 with bar 150. Bracing member 158 is coupled with bar 156 and post 148. A winch 160 is mounted on bracing member 158 and may be connected to a pair of hooks 162 and 164 which are securely mounted on the bumper 20. A cable 166 may be used to couple the winch 160 with hooks 162 and 164. Similarly, winches 168 and 170 are mounted on bracing members 152 and 154 and may be coupled with hooks 172 and 174 mounted on a forward portion of framework 14. Cables 176 and 178 are used to couple winches 168 and 170 with the hooks. The cables are routed through hooks 180 and 182 which are mounted on bar 150.

When the distributor 10 is to be coupled with trailer 12, it is maneuvered into position behind the trailer by carriage 136. Temporary bumpers 132 and 134 are removed and the distributor is maneuvered so that framework 14 slides within the mounting frame 114 on the trailer. The frame and framework are then bolted together, the winch cables 166, 176 and 178 disconnected from hooks 162, 164, 172 and 174, and the carriage removed. Hydraulic lines 106 and 108 are then coupled with lines 42 and 44 to allow hydrostatic operation of the pump 34. The suction line 46 may then be coupled with flow line 86 and return line 50 is attached to line 98. After the necessary electrical and pneumatic connections are effected, the trailer 12 may be driven to the site for application of the liquid bituminous product to a road surface. When the liquid is to be applied, the hinge sections 58 and 60 of spray bar 54 are lowered to their operating positions. Hydraulic motor 38 is activated and pump 34 draws bituminous product from tank 84 and discharges it into distribution line 48. When valve 88 is opened by ram 94, valve 90 is closed by ram 96 and bituminous product is drawn from the forward portion of the tank. Alternately, valve 88 may be closed and valve 90 opened to draw bitumen from the rear portion of the tank. The bituminous pumped through distribution line 48 may be circulated through lateral line 76, spray bar 54, and lateral line 78 when control lever 80 is positioned to open and close the appropriate valves. Product may be discharged through nozzles 72 and applied to the road surface by opening nozzle valves 70. Hydrostatic operation of the pump allows the discharge rate through the nozzles 72 to vary with the road speed of the trailer 12. Valve 100 may also be opened to allow the bitumen to be routed to the tank 84 through return line 50. Bitumen may also be transferred to the tank from another storage tank by attaching a flow line to the fill line 52 and operating the pump 34.

When the road surfacing operations are completed and the distributor 10 is to be removed, the carriage 136 is moved into position and the cables are coupled with the framework hooks and tensioned by the winches. Valves 88 and 90 are closed and the suction line 46, return line 50, and hydraulic lines 42 and 44 are quickly disconnected. The distributor ramework 14 is then unbolted from the mounting frame 114 on the trailer. The distributor 10 may then be removed by movement of the carriage 136. The temporary bumpers 132 and 134 are then replaced and the trailer 12 is ready for use as an over the road rig for hauling of the bituminous product.

Thus, the distributor 10 of the present invention may be quickly and easily maneuvered by carriage 136 into position for attachment to and removal from the trailer 12. The detachable distributor allows the trailer to be used for applying the bituminous product contained in the trailer to a road surface and also allows the trailer to serve as an over the road rig for hauling of the bituminous product.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. A distributor for applying liquid to a surface, said distributor comprising:

a framework having a forward end with coupling means for detachably mounting said framework on a rear end of a vehicle having a tank for containing said liquid, said framework being supported entirely by said vehicle when coupled therewith;

a pump mounted on said framework;

a spray bar mounted on said framework and coupled with said pump by a first conduit;

a second conduit having one end coupled with said pump and having another end for coupling with said tank to direct fluid contained therein to said pump for delivery through said first conduit and distribution by said spray bar to the road surface;

a third conduit having one end coupled with said pump and another end for coupling with said tank to selectively return liquid directed to said pump back to the tank and;

a bumper mounted on a rear end of said framework.

2. The invention of claim 1, including a hydraulic motor coupled with said pump and wherein is included means for coupling said motor with a hydraulic reservoir.

3. An apparatus for applying liquid to a surface, said apparatus comprising:

a vehicle having a tank for containing said liquid;

a distributor comprising a framework with means for detachably mounting said distributor with a rear end of said vehicle, a spray bar mounted on said framework, and means for directing said liquid from said tank to said spray bar for application to said surface, said distributor mounting means being adapted such that said distributor is supported entirely by the vehicle when coupled therewith;

a carriage having means for releaseably supporting said distributor, wherein said distributor may be positioned for coupling with and removal from said vehicle by said carriage and;

a bumper mounted on a rear end of said framework.

4. The invention of claim 3, wherein said distributor includes a pump mounted on said framework for pumping fluid through said directing means.

* * * * *